United States Patent [19]

Reist et al.

[11] 4,058,202

[45] Nov. 15, 1977

[54] APPARATUS FOR PROCESSING PRODUCTS ESPECIALLY PRINTED PRODUCTS

[75] Inventors: Walter Reist, Hinwil; Egon Hänsch; Reinhard Gösslinghoff, both of Wetzikon, all of Switzerland

[73] Assignee: Ferag AG, Hinwil, Switzerland

[21] Appl. No.: 655,562

[22] Filed: Feb. 5, 1976

[30] Foreign Application Priority Data

Feb. 26, 1975 Switzerland ..... 2430/75

[51] Int. Cl.[2] ..... B65G 29/00

[52] U.S. Cl. ..... 198/482; 198/614; 198/803; 270/55; 271/82; 271/173; 271/277; 198/778

[58] Field of Search ..... 198/103, 107, 210, 211, 198/482, 486, 613, 614, 778, 803; 271/80, 82, 173, 233, 250, 252, 277, DIG. 10; 270/55, 57, 58

[56] References Cited

U.S. PATENT DOCUMENTS

| | | | |
|---|---|---|---|
| 2,031,136 | 2/1936 | Sewick | 271/80 |
| 2,630,908 | 3/1953 | Anderson | 198/211 |
| 2,634,971 | 4/1953 | Schweizer | 270/55 |
| 2,780,927 | 2/1957 | Boyce et al. | 198/211 X |
| 2,809,831 | 10/1957 | Nordquist | 271/250 X |
| 3,076,647 | 2/1963 | Lowe et al. | 271/173 |
| 3,527,455 | 9/1970 | Reist | 270/55 |
| 3,606,308 | 9/1971 | Mowry et al. | 271/277 |
| 3,744,415 | 7/1973 | Ras | 101/211 X |
| 3,841,622 | 10/1974 | Swanson | 271/82 |
| 3,941,240 | 3/1976 | Rasenberger | 198/403 |
| 3,951,399 | 4/1976 | Reist | 271/173 X |

*Primary Examiner*—John J. Love
*Assistant Examiner*—Richard K. Thomson
*Attorney, Agent, or Firm*—Werner W. Kleeman

[57] ABSTRACT

An apparatus for processing printed products wherein the product copies are introduced at an infeed location into individual compartments of a revolving cell wheel, processed during the time they are present in the compartments and removed from the compartments at a removal location. The infeed location and removal location are arranged in offset relationship in the direction of the lengthwise axis of the cell wheel. Each compartment has arranged therein, in an axial direction, entrainment means movable between a work stroke and a return stroke, the entrainment means of each compartment being operatively coupled with one another. The entrainment means are driven by a drive embodying a common stationarily arranged guide track describing a closed curve and follower elements rotating with the cell wheel.

38 Claims, 10 Drawing Figures

APPARATUS FOR PROCESSING PRODUCTS ESPECIALLY PRINTED PRODUCTS

BACKGROUND OF THE INVENTION

The present invention is in the field of product processing equipment and, in particular, relates to a new and improved apparatus for processing products, especially but not exclusively printed products.

The apparatus of the invention is generally of the type wherein each of the copies are introduced at an infeed location into compartments or cells of a revolving cell wheel, are processed while residing or dwelling in the compartments, and removed from the compartments at a removal location.

In the context of this disclosure and as will be evident from the discussion of the exemplary embodiments to follow the term "printed products", whether used in the singular or the plural, has ascribed thereto a broad meaning, specifically relates to any type of article or product which can be handled with the equipment of the invention, such as for instance, newspapers, books, inserts, sheets, periodicals, magazines and so forth. Equally, the term "processing", as relates to the apparatus of the invention, is intended to have a broad meaning and encompasses many different operations which can be carried out with the apparatus, such as by way of example, product handling, product transferring, product stuffing, product shifting, product collating, product cutting, product labeling and so forth.

The processing of printed products, copy-for-copy, in the compartments or cells of a cell wheel, in particular the stuffing of inserts into folded printed products, or the collating of individual product sections into a complete product, is already known. Each processing step requires a certain processing time which is governed by the nature of the processing operation and the nature of the processed printed product. On the other hand, the production capacity of machines producing such printed products has noticeably increased in recent times. For instance, production rates of 50,000 copies and more per hour are readily possible at the present time when utilizing rotary printing presses. If it were intended to accommodate a prior art apparatus of the previously mentioned type, prossessing a cell wheel having a vertical axis, to the production output or capacity of, for instance, a modern day rotary printing press with the intent that the apparatus should be capable of processing the entire production output so-to-speak on-line, then the cell wheel, while taking into account the processing time required for each copy, would possess such large dimensions that, as a practical matter, the same could not be realized and, in any event, dimensions of a magnitude such that the manufacture of such type equipment no longer could responsibly guarantee for the operational reliability thereof.

Hence, in view of the fact that there was no practical on-line processing equipment which could effectively handle such large production outputs, it was necessary to initially deliver the printed products emanating from the production machine in the form of a product stack to an intermediate store. Thereafter, the products are delivered from the intermediate store to one or a number of devices for further processing of the products, for instance by supplementing the same with inserts, cutting, folding or labeling them.

SUMMARY OF THE INVENTION

It will be apparent from the above discussion that this particular field of technology is still in need of product processing or handling apparatus not associated with the shortcomings of the prior art equipment as explained heretofore. Hence, it is a primary object of this invention to provide improved product processing apparatus which effectively fulfills the existing need in the art.

Another and important object of this development aims at the provision of a new and improved construction of apparatus of the previously mentioned type wherein the take-up capacity i.e., product receiving capability and the processing time do not affect the dimensional considerations of the apparatus such that these factors are decisive for the diameter of the cell wheel and the number of compartments of the cell wheel.

Still a further object of this invention aims at the provision of a novel apparatus for handling products providing a true on-line capability which enables the apparatus to work so-to-speak in step with a product supply device having high output capacity, and importantly without the need for unduly vast dimensions of the product handling apparatus.

Yet a further significant object of this invention relates to the provision of a novel product handling apparatus capable of receiving products at the same rate as such are infed from a high speed printer, while insuring from proper processing of the products in an extremely reliable and efficient manner and without any appreciable danger of product damage.

A concomitant object of the present invention resides in a new and improved construction of apparatus for handling products in an extremely safe, reliable and efficient manner, with structure which is relatively economical to realize, possessing high-performance characteristics, and requiring relatively little servicing and maintenance.

Now in order to implement these and still further objects of the invention, which will become more readily apparent as the description proceeds, the apparatus of this development is manifested by the features that the infeed location and the discharge location are arranged in offset relationship in the direction of the lengthwise axis of the cell wheel. Further, in each compartment there are arranged in the axial direction of the cell wheel entrainment members movable through a work stroke and a return stroke. The entrainment members of each compartment or cell are operatively coupled with one another and can be driven by means of a drive possessing a common stationarily arranged guide track describing a closed curve and follower elements rotating with the cell wheel.

Hence, during such time that each printed product dwells in one of the compartments or cells of the cell wheel each printed product describes so-to-speak a spiral-or helical-shaped path which revolves as many times around the axis of the cell wheel as required by the residence or dwell time in the compartment i.e. the processing time. This movement of each printed product is in contrast to the essentially flat arcuate movement which is present with the prior art apparatus. Due to this novel spiral- or helical-shaped movement of each printed product the diameter of the cell wheel can be made considerably smaller than that of the prior art apparatuses, because the inventive apparatus need only be dimensioned longer in its axial extent. This can be realized without any particular difficulties. Moreover, the entrainment members insure that each printed product at any point in time during the course of its movement along the spiral-shaped path, measured from the infeed at the infeed location, exactly assumes the proper required for the contemplated processing operaion.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
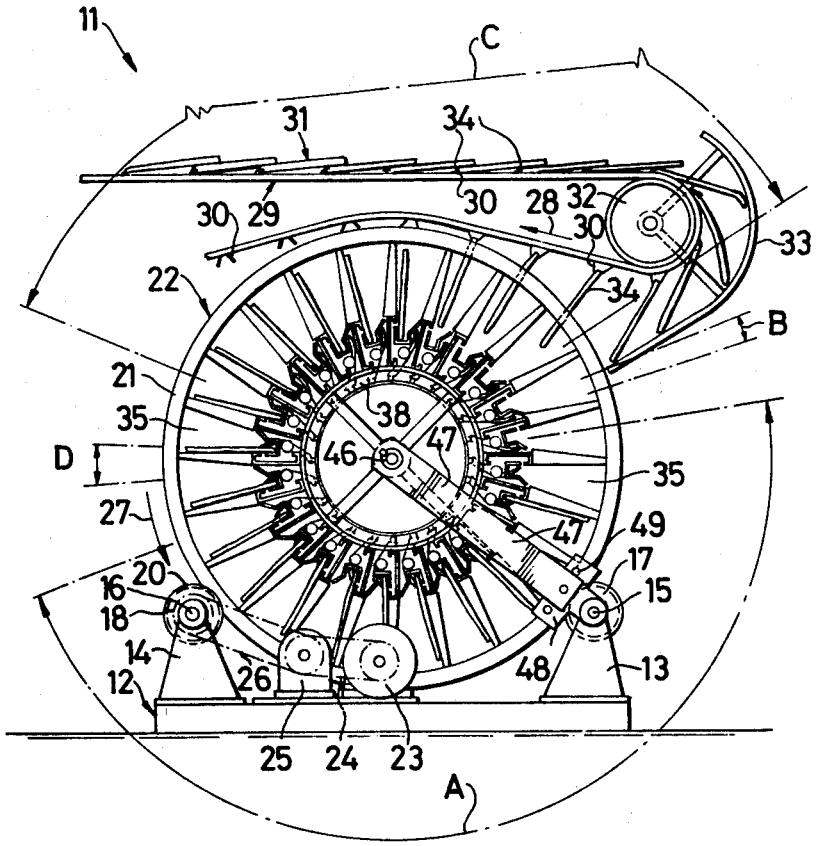
FIG. 1 is a schematic end view of an apparatus equipped with a cell wheel having a substantially horizontal axis.
Figure 2:
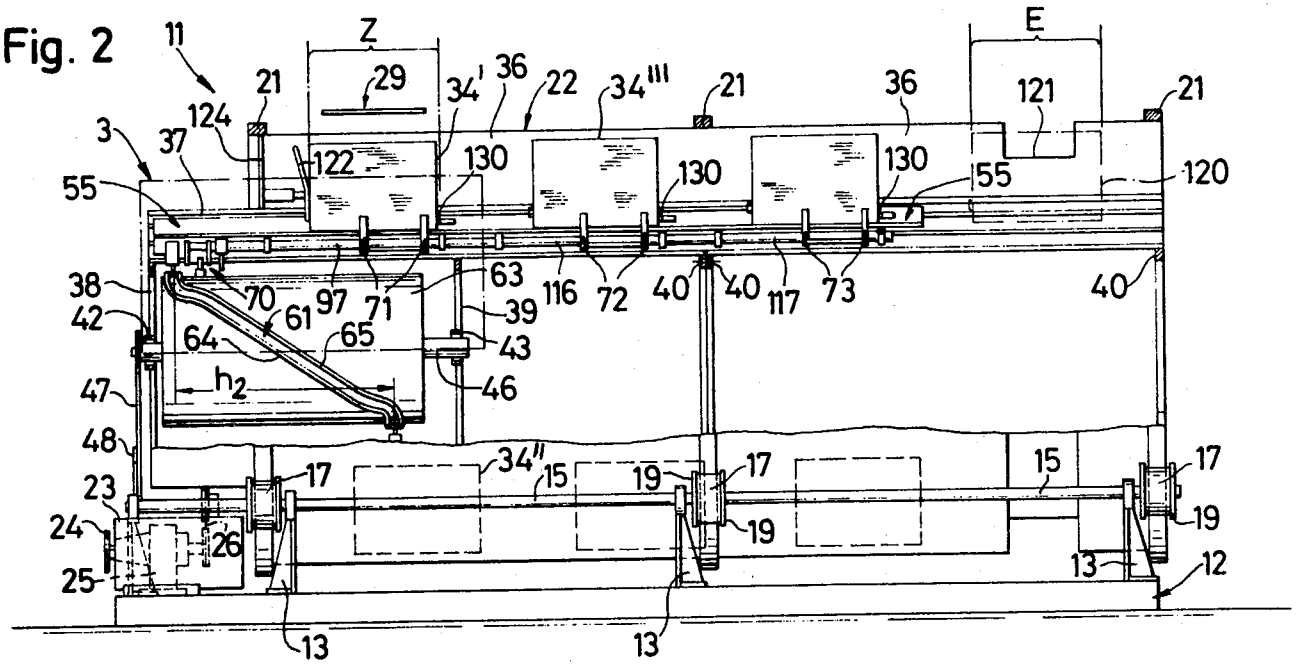
FIG. 2 is a side view of the apparatus of FIG. 1, partially shown in section and with parts broken away to reveal internal structure.

The apparatus 11 illustrated in FIGS. 1 and 2 in a simplified total portrayal will be understood to comprise a substantially rectangular base plate 12. Along both lengthwise extending sides of the base plate 12 there are mounted thereon, at essentially equidistant spacing, the bearing blocks 13, 14 in which there are mounted the respective shafts 15, 16 in the manner of transmission shafts. Seated at the same elevation upon these shafts 15 and 16 are rotatable support rolls 17 and 18, respectively, which are provided at both of their end surfaces with flanges or rims 19 and 20 respectively. Upon the contact surfaces of the support rolls or rollers 17, 18 there travel screw collar rings 21 or equivalent structure which hold together the axially abutting sections of a cell wheel, generally designated in its entirety by reference character 22.

Continuing, secured to the base plate 12 is a suitable drive motor 23 which, through the agency of a chain 24, reduction gearing 25 and a chain 26, drives at least the support roller or roll 18 appearing at the left-hand side of FIG. 1. However, it is to be appreciated that all of the support rolls 18 seated upon the shaft 16 could be driven. The contact surface of the driven support 18 can be provided with teeth and can mesh with corresponding teeth provided at the periphery of the associated screw collar ring 21, for instance in the manner of a mangle gear. To preserve clarity in illustration such tooth structure has not been shown in the drawings of FIGS. 1 and 1. From what has been explained above it will be apparent that the cell wheel 22, the structure of which will be considered more fully hereinafter in conjunction with FIGS. 3 and 4, is driven in the direction of the arrow 27, the driving power or force being effective at the circumference of the cell wheel 22.

The upper region of the periphery of the cell wheel 22 is spanned at the section (infeed location) designated by reference character Z in FIG. 2 by the end of a feeder or infeed conveyor 29 driven in the direction of the arrow 28. The conveyor 29 is equipped at a uniform spacing along the extent thereof with controlled grippers 30, each of which fixedly hold the associated trailing edge of a printed product 34 of an imbricated product stream 31 reposing upon the upper run of such feeder or conveyor 29. This conveyor 29 is guided about a deflecting roll or roller 32 surrounded by a guide member 33, for instance a sheet metal guide. During the course of the deflection of the conveyor 29 about the deflecting roll 32 the printed products 34 are moved out of the imbricated product stream 31, their leading edges slide along the inside of the sheet metal guide or guide member 33 and then hang downwardly from the run of the conveyor 29 which travel off the deflecting roll 32, as shown in FIG. 1. In this condition the printed products 34 penetrate into the compartments 35 of the cell wheel 32 and thereafter the grippers 30 are opened by any suitable and therefore not particularly illustrated means, so that the printed products 34 fall under the action of their own weight each into a compartment of the cell wheel. It should be apparent that the speed of travel of the conveyor 29 as well as the equipping of such conveyor with grippers 30 and the rotational speed of the cell wheel 22 are accommodated to one another such that the passing movement of the compartments with respect to the grippers is synchronous and in-phase. It also should be apparent that the infeed location Z can have arranged upstream thereof a different infeed device than the illustrated conveyor 29, for instance a so-called press feeder which has the capability of inserting a printed product into each of the compartments in synchronism with the movement of the compartments. After the insertion into the relevant compartment the printed products assume the position indicated by the outline 34' of FIG. 2.

From the showing of FIG. 1 it will be apparent that the illustrated cell wheel 22 possesses 24 compartments or cells. Consequently, for receiving an arriving quantity of, for instance 35,000 copies per hour the cell wheel 22 need only carry out about 25 revolutions per minute, and with an infeed rate of 80,000 copies per hour only about 56 revolutions per minute. Such rotational speeds can be readily realized in practice, even in the case of wheels having a diameter of about 1.6 meters — as is the case here — but they hardly insure for sufficient residence or dwell times (2.4 or 1.07 seconds respectively) in order to allow for the infeed, the processing and the removal of the printed products during the course of a single rotation of the cell wheel.

Figure 3:
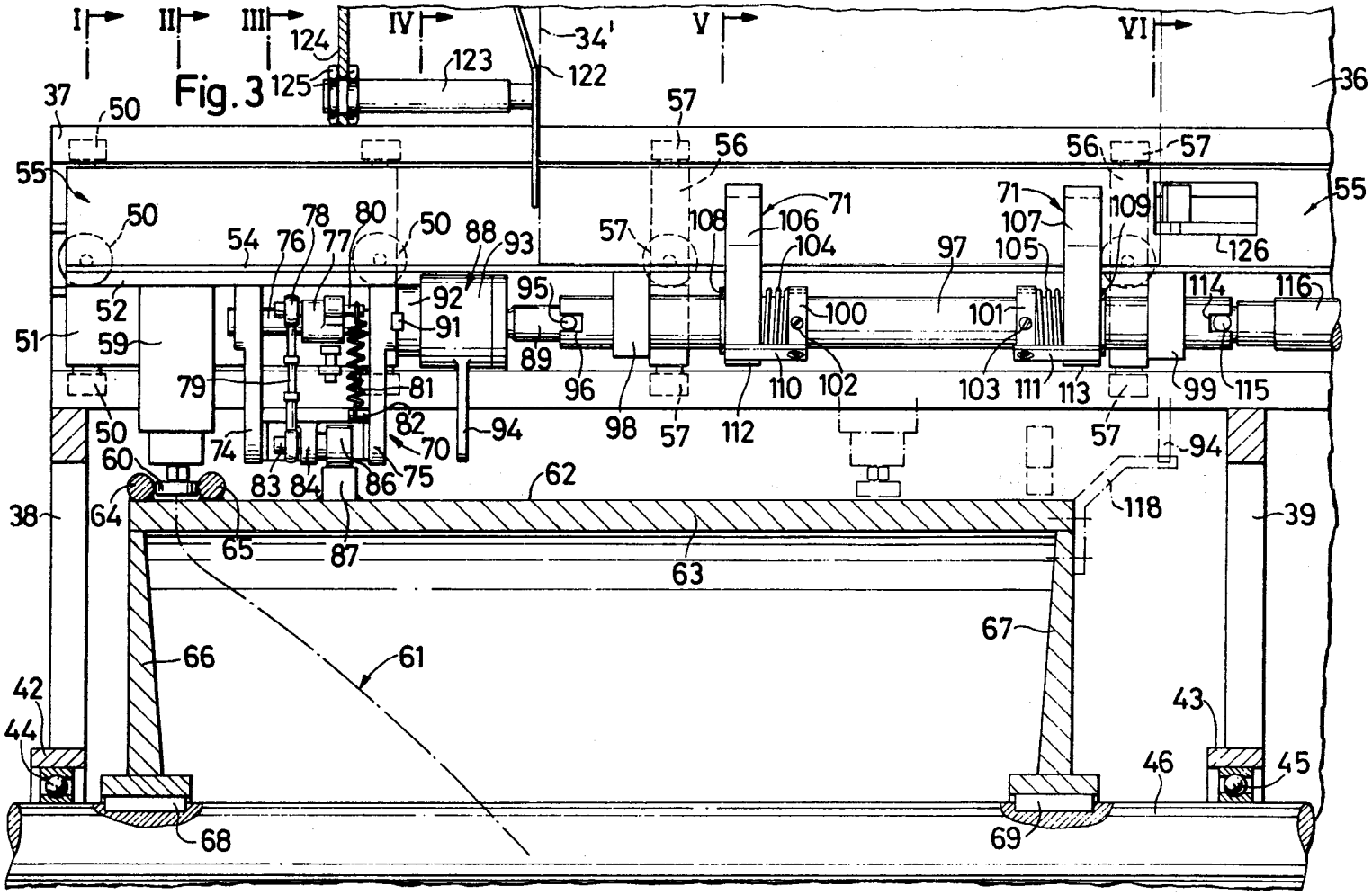
FIG. 3 is an enlarged sectional view of a part of the apparatus depicted in FIG. 2 and enclosed within the phantom line block designated by reference character 3.
Figure 4:
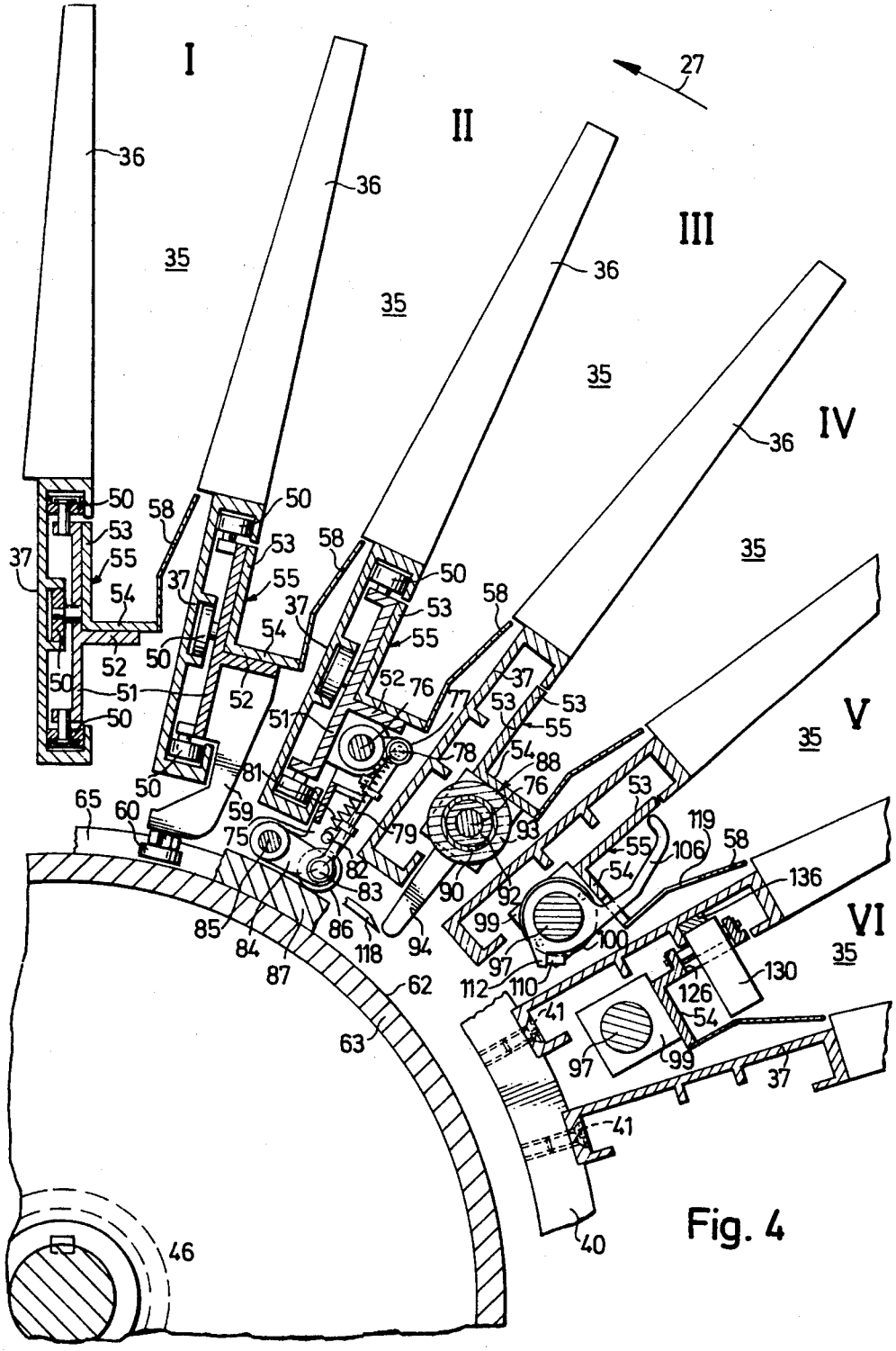
FIG. 4 is a cross-sectional view of the arrangement of FIG. 3 wherein from one compartment to the next compartment the axial position of the section planes have been marked by the reference characters I to VI inclusive and in FIG. 4 the corresponding compartment similarly designated.

Reference now will be further made to FIGS. 3 and 4 portraying the construction of the cell wheel 22. The compartments or cells 35 of the cell wheel 22 are laterally bounded by partition walls 36, for instance formed of beveled sheet metal. The one face of one of the partition walls 36 bounds the one compartment and the other face of such partition wall the neighboring compartment. As illustrated in FIG. 2 the partition walls 36 extend almost over the entire length of the cell wheel 22. At its narrow side closer to the axis of rotation of the cell wheel each of the partition walls 36 is anchored, for instance by means of bolts or rivets, at the outside or outer surface of one leg of an essentially C-shaped profile rail 37.

These profile or structural rails 37 extend essentially over the entire length of the cell wheel 22 and in turn are anchored at a uniform spacing at the outside of their other leg at the periphery of support wheels 38, 39 and support rings 40, anchoring being accomplished for instance with the aid of counter-sunk screws or bolts 41 or equivalent structure, as best seen by referring to FIG. 4. The hubs 42 and 43 of the support wheels 38 and 39, respectively, are rotatably mounted by means of ball bearings 44 and 45, respectively, upon a support shaft or axle 46 which thus is only supported via the support wheels 38 and 39 and the cell wheel 22. The support axle 46 is secured against rotation by means of an arm or cantilever 47 keyed to one end of such support axle 46. The free end of the arm or cantilever 47 is pinned with an apertured segment 48 having a number of bores or holes 49, so that in this way it is possible to adjust and fix the support axle 46 in its relative rotational position. As to the further function of the support shaft or axle 46 the same will be considered hereinafter.

At this point reference is again made to the profile rails 37 which not only serve for anchoring the partition walls 36, but also for guiding a respective carriage 51 equipped with a total of, in this case, six rollers or rolls 50. Carriage 51 possesses a support flange 52 formed thereat and protruding from the profile rails 37. At the carriage 51 and at the support flange 52 there is secured, for instance, by means of bolts or equivalent structure, the outside of a respective one of the legs 53, 54 of a profile element 55 having a substantially L-shaped cross-sectional configuration. As best seen by referring to FIG. 2 the length of the profile elements 55 is smaller than that of the profile rails 37 and corresponds approximately to the length of the partition walls 36. The profile elements 55 thus can be displaced along the profile rails 37. In order to insure for a faultless guiding action there are secured guide brackets 56 at a uniform spacing from one another at the outside or outer surface of the leg 53 of each of the profile elements 55. These guide brackets 56 are equipped with rollers 57 engaging with the profile rails similar to the rollers 50 (FIG. 3).

The inner surface or inside of the leg 53 of each profile element 55 is in alignment with the one side or face of the partition wall 36 secured at the same profile rail 37, and at the free end edge of the leg 54 of the profile element 55 there is secured a guide member 58, for instance formed of sheet metal, and having a slightly bent cross-section. The face or side of the guide member 58 confronting the profile element 55 is in alignment with the other side of the neighboring partition wall 36 (FIG. 4).

Hence, it will be understood that each of the profile elements 55 together with the guide member 58 secured thereat bounds or delimits the floor region of the associated compartment or cell 35, this floor being displaceable in the axial direction of the cell wheel 22.

For accomplishing the drive of this axial displacement there is provided at each of the carriages 51 a radially inwardly extending, rather massive arm or cantilever 59, at the inner end of which there is rotatably mounted a follower roller or roll 60 about a shaft which is radially directed with respect to the rotational axis of the cell wheel 22. The roll 60 engages with a small amount of play as a follower element at the flanks of a guide track designated by reference character 61 in FIGS. 2 and 3. The flanks of said guide track 61 are formed by two round or circular profile members 64, 65 secured, for instance by welding, to the outer jacket surface 62 of a cylindrical drum 63. The substantially circular or round profile members 64 and 65 extend essentially in parallelism. Viewed in space these round profile members 64, 65 possess approximately the shape of an ellipse which bears at the cylindrical jacket surface 62 so that the guide track 61 describes an endless or closed curve which extends from one end of the drum 63 to its other end and after wrapping once around the drum again extends back to its one end. As best seen by referring to FIG. 3 the drum 63 is supported at both ends at a respective disk 66, 67, both of these disks being seated rigidly for rotation upon the support axle or shaft 46, in particular the disks are rigidly fastened at the disk centers by means of keys or wedges 68, 69 or other suitable structure to the support axle.

The drum 63 and thus the guide track 61 are therefore stationarily arranged although their relative rotational position can be adjusted and fixed to a limited extent by the adjustment of the anchoring of the arm or cantilever 47 at the apertured segment 48. Since each of the rollers or rolls 60 is always in engagement with the guide track 61, the same and along with it the associated carriage 51 and the components secured thereat namely, the profile element 55 and the guide member 58, in other words practically the floor or bottom of each of the compartments or cells 35, carries out during the course of a rotation of the cell wheel 22 a work stroke and a return stroke by an amount conveniently designated by reference character $h_2$ in FIG. 2. The stroke defined by the guidetrack 61 amounts to $1/n$, i.e., a fraction, $n$ being an integer of the axial spacing between the infeed and outfeed locations. It should be apparent that the speed with which there is carried out the work stroke and the return stroke as well as the residence or dwell time at the end of one of such strokes (dead-center point) is dependent upon the shape of the spatial curve described by the guide track 61. Hence, it is possible to distribute the work stroke and/or the return stroke over a greater or smaller angular range of one revolution of the cell wheel, and still to increase or decrease the dwell times at the end of such stroke within certain limits. These are however parameters which, among other things, are also dependent upon the processing to which the printed products are subjected during their residence time in the compartments or cells. In FIG. 2 the guide track 61 has been illustrated for the sake of simplicity in such a manner that during throughpassage of the visible side from the top towards the bottom there is carried out the work stroke. However, this need not of necessity be so, as will be explained further hereinafter and as will be apparent from a comparison of the outline 34' with the further outlines 34'', 34''' and so forth of FIG. 2. In reality it is advantageous if the work stroke, and therefore the axial displacement of the printed products occurs approximately during the passage through the compartment or cells 35 below the rotational axis of the cell wheel 22, for instance in that sector which has been designated by reference character A in FIG. 1.

An axial shifting or displacement of the printed products in the compartments 35 is not yet possible with sufficient accuracy merely due to the axial displacement of the profile element 55 with the guide member 58, because the printed products during the course of the rotation of the cell wheel also bear with frictional contact at the side or face of the axially non-movable partition wall 36. Hence, for each compartment 35 there are provided entrainment means embodying axial grippers coupled with one another and movable along with the profile element 55 and the guide member 58. In the exemplary embodiment under consideration three gripper sets 71, 72, 73 (FIG. 2) are provided, which are of the same construction and can be actuated by means of a common drive mechanism 70 (FIG. 3). Therefore, it should be sufficient if in the present case there is described the common drive mechanism 70 for all gripper sets or assemblies as well as the gripper set 71 itself, reference being made in this regard to FIGS. 3 and 4.

Two bearing arms 74, 75 are attached at the carriage 51 below the support flange 52. Pivotably mounted in these bearing or support arms 74, 75, at the region of the support flange 52, is a pivotal or pivot shaft 76. A crank arm 77 is rigidly attached for rotation to the pivotal shaft 76 and at the free end of crank arm 77 there is articulated, at location 78, a lengthwise adjustable hinge rod 79 and at location 80 there is secured one end of a traction or tension spring 81, the other end of which is anchored at a pin 82 protruding from the bearing or support arm 75. The lower end of the hinge rod 79 is hingedly connected at location 83 with the free end of a rocker or balance 84 which, in turn, is pivotable about a hinge pin 85 extending between the lower ends of the bearing or support arms 74, 75. At the free end of the rocker 84 there is additionally arranged a rotatable roller 86 which cooperates with a cam or dog 87 which in turn is secured to the jacket or outer surface 62 of the drum 63 at the region of the dead-center point of the guide track 61 appearing at the left-hand side of FIG. 3. The tension spring 81 thus brings about a pre-biasing of the roller 86 towards the drum 63 and the cam 87 thus raises the roller 86 against the action of the tension spring, resulting in a rocking of the pivotal shaft 76 in the counterclockwise direction of FIG. 4.

The non-visible end of the pivotal shaft 76 which extends to the right of FIG. 3 past the support or bearing arm 75 is guided within an unlockable or releasable free-wheeling device 88 and at that location is rigidly coupled for rotation at a coaxial shaft journal or extension 89. The free-wheeling device 88 is of the type which normally allows rotation of the pivotal shaft 76 and thus the shaft extension 89 in the counterclockwise direction (FIG. 4) but blocks rotation in the clockwise direction. If the free-wheeling device 88 is unlocked then it allows rotation of the components 76 and 89 in both rotational directions. The free-wheeling device 88 can be a type of a precision-spring coupling which has become known in the art under the designation "Curtiss-Wright" and commercialized by Marquette Metal Products Co., Cleveland, Ohio and/or its licensees, and in which coupling a spiral or helical spring is anchored at one end at one part or component to be coupled and is wrapped around the other part or component to be coupled. In the embodiment under discussion the one end of this spring 90 (only visible in section in FIG. 4 in the compartment or cell 35 IV) is attached with a coupling part or component 92 rigidly rotatably anchored by means of a key or wedge 91 or equivalent structure at the bearing arm 75. Moreover, the spring frictionally wraps about both the shaft 76 as well as also the shaft journal or extension 89 and not particularly shown but conventional wedge collar intercoupling both of these components.

With suitable selection of the sense of winding or coiling of the spring 90 the parts 76 and 89 can thus rotate in the one direction because then the spring 90 has a tendency of increasing the inner diameter of its coils, resulting in the parts or components 76 and 89 being able to rotate internally of the spring 90. In the other rotational direction of the parts 76 and 89 the spring 90 has the tendency of contracting its coils, producing a press fit of the spring 90 upon the parts 76, 89 and along therewith a blocking of these parts because the one end of the spring 90 is of course non-rotatably attached at the coupling part or component 92. On the other hand, the other end of the spring 90 is secured internally of a control sleeve 93 which freely rotatably bears upon the outer diameter of the spring 90. Secured to the control sleeve 93 is an actuation arm 94. If this arm 94 is rocked in counterclockwise direction in FIG. 4, then the spring 90 in any event is caused to enlarge the inner diameter of its coils, so that the parts 76 and 89 are freed for carrying out an unhindered rotation in both rotational directions.

It should be apparent from what has been discussed above that upon run-on of the roller 86 upon the cam 87 the pivotal shaft 76 and thus the shaft journal or extension 89 are rocked or pivoted, and blocked in the thus rocked position by the free-wheeling device 88 as long as such is not unlocked by rotating the control sleeve 93. The tension spring 81 thus also cannot become effective at the end of the cam 87 and rotate back the parts 76 and 89 as long as the free-wheeling device 88 is effective. The advantageous consequence of this construction resides in the features that a very short construction of the cam 87 is possible and only serves for the rocking of the parts 76 and 89 in the one direction, i.e. — as will be shortly explained — for closing the grippers of the sets 71 to 73, whereas the rotation of the parts 76 and 89 in the other direction, i.e. the opening of the grippers, under the action of the tension spring 81 is first then released due to the rotation of the control sleeve 93. The closing and opening of the grippers therefore occurs by two separate elements which accordingly also can be separately arranged and in principle independent of the guide track 61.

The end of the shaft projection or extension 89 appearing at the right-hand portion of FIG. 3 is rigidly coupled for rotation by means of a coupling which allows for errors in alignment, in this case by means of a pin 95 with the end of a gripper shaft 97 and which shaft end is provided with a transverse slot 96. The gripper shaft 97 is rotatably mounted in two bearings 98, 99 which are secured at the underside of the leg 54 of the profile element 55. Fixedly clamped upon the shaft 97 at sections or regions between the bearings 98, 99 are two clamping rings 100, 101 with the aid of pins or screws 102, 103 or other suitable fastening means. At the clamping rings 100 and 101 there is secured the one end of a respective spiral spring 104, 105 surrounding with adequate play the gripper shaft 97. The other end of these spiral springs 104, 105 are each inserted in the hub portion of a respective gripper jaw 106, 107 rotatably mounted upon the gripper shaft 97. These gripper jaws 106, 107, in turn, are secured by means of a spring ring or lock washer 108 and 109, respectively, against axial displacement upon the gripper shaft 97 under the action of the corresponding spiral spring 104 and 105 respectively. At each of the clamping rings 100 and 101 there is attached an entrainment finger 110 and 111, respectively, which extends in the direction of the associated gripper jaw and at that location coacts with a stop nose 112 and 113, respectively, formed at the hub portion of the relevant gripper jaw.

It should be equally apparent from the previous discussion and the showing of FIG. 4, particularly compartment or cell 35 V, that during rotation of the gripper shaft 97 in the counterclockwise direction and produced by the drive mechanism 70, the free end of each gripper jaw 106 and 107 respectively, approaches the inside of the leg 53 of the profile element 55, which leg thus functions as a fixed or stationary counter jaw for the movable gripper jaws 106 and 107 respectively. On the other hand, the gripper jaws 106 and 107 are resiliently coupled with the gripper shaft 97, so that the grippers also are capable of positively fixedly clamping printed products of different thickness without there being necessary an adjustment of the gripper jaws to the thickness of the printed products.

The end of the gripper shaft 97 extending past the bearing 99 is likewise provided with a slot 114 as best seen by referring to FIG. 3. A pin 115 engages in this slot and extends transversely through the end of a further gripper shaft 116, which end appears at the right side of FIG. 3. The gripper shaft 116 constitutes part of the gripper set or assembly 72 (FIG. 2) which moreover is constructed the same as the previously described gripper set 71. At the other end of the gripper shaft 116 there is coupled in the same manner a further gripper shaft 117 which is part of the gripper set or assembly 73 (FIG. 2) which in turn is again similarly constructed as the gripper set 71.

It follows therefore that the printed products in the compartments or cells 35 are forwardly advanced by an amount corresponding to the work stroke *h*, while engaged by the gripper jaws of one of the gripper sets 71 to 73 whenever the printed products pass through the rotation sector A (FIG. 1). At the end of this work stroke, i.e. approximately at the rotation sector B (FIG. 1) following the rotation sector A, the actuation arm 94 of the control sleeve 93 travels upon a bracket or control track 118 or the like shown in phantom lines in FIG. 3 and secured to the drum 63 and the disk 67 respectively, with the result that the control sleeve 93 rotates, all gripper shafts 97, 116 and 117 are released for rotation under the action of the tension spring 81 and thus all of the gripper jaws of the gripper sets 71 to 73 are opened. The control track or bracket 118 has been portrayed in phantom lines in FIG. 3 because in reality it is arranged at the region of the dead-center point of the guide track 61 appearing at the right-side thereof and which is not visible in FIG. 3. After the opening of the gripper jaws all of the gripper sets 71 to 73 together with the associated profile elements 55 and all parts axially displaceable along the corresponding compartment or cell 35 undergo the return stroke, for instance in the rotation sector C of FIG. 1 which follows the sector B, whereupon there is again attained the starting position of FIG. 3. During the return stroke the gripper jaws 106 engaging through a continuous opening 119 (FIG. 4 compartment or cell 35 V) in the sheet metal guide 58 as well as in the leg 54 of the profile element 55 remain in their open position in which they practically depart out of the trough formed by the profile element 55 and the sheet metal guide 58. Only at the end of the return stroke are the grippers again closed, for instance during passage through the rotation sector D (FIG. 1) which follows the rotation sector C. As a result, the gripper jaws 106, 107 of the gripper set 71 engage the printed product which shortly before was released by the conveyor 29 and which dropped into the relevant compartment or cell 35, whereas the gripper jaws of the gripper set 72 engage those products which have been advanced (as indicated schematically by the outline 34''' of FIG. 2) during the preceding rotation of the cell wheel 22 and while said products were engaged by the gripper jaws 106 and 107, and finally, the gripper jaws of the gripper set 73 engage those products which during the preceding rotation of the cell wheels 22 were axially forwardly advanced under the gripping action of the gripper jaws of the set 72.

At the end of the work stroke the gripper jaws of the set 73 release the printed product in the position indicated by the phantom outline 120 of FIG. 2. In this axial terminal region of the compartment 35 there is provided in each of the partition walls 36 a recess or opening 121 through which there is freely accessible an edge of the now processed printed products. Extending through these openings 121 is for instance an outfeed conveyor (not shown) which is provided with grippers like the infeed conveyor 29 and which radially withdraws the processed copies or other articles as the case may be, out of the compartments 35. In this exemplary case the region where there are provided the recesses 121 constitutes the removal location of the apparatus 11. There can be however provided also other outfeed conveyors, for instance those which merge axially at the end of the compartments 35 at the right of FIG. 2. In this case there would be required for each compartment a further gripper set following the gripper set 73 and such ends of the compartments 35 would then be open. It will be recognized that the printed products during their passage through the apparatus 11 to a certain extent describe a stepped spiral-shaped path of movement.

Since, as mentioned, the processing of the printed products occurs during passage through the apparatus 11 such printed products must have an exactly defined position in the relevant compartment or cell 35 at any moment of time that the same are resident or dwelling therein. For this purpose there is provided already at the start of each of the compartments or cells 35 a guide member or guide 122, for instance constituted as a sheet metal guide (FIGS. 2 and 3). The guide member 122 is secured at a lengthwise adjustable arm or cantilever 123 which, in turn, is attached by nuts 125 or other appropriate fastening devices at a substantially circular ring-shaped cover disk 124. This cover disk 124 closes the left-hand end face of all compartments or cells 35. The guide member 122 is however only capable of positioning such printed products which at the infeed location Z have been inserted into the associated compartment 35 displaced too far towards the start of such compartment 35. All printed products which, during introduction into the compartment, do not contact the guide member 122, therefore are in an undefined position. In order to overcome this shortcoming there are provided control stops or impact members which will be described more fully hereinafter in conjunction with FIGS. 3 and 7 to 10. There will be recognized in FIG. 3 that a continuous or throughpassing opening 126 is provided approximately at the height of the bearing 99 in the leg 53 of the profile element 55.

Figure 9:
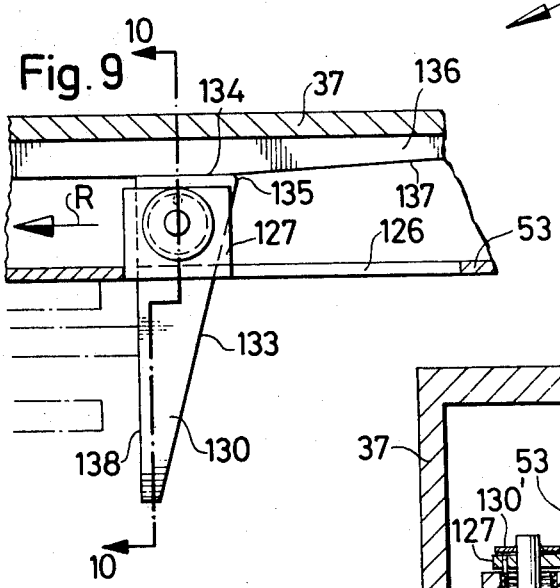
Figure 10:
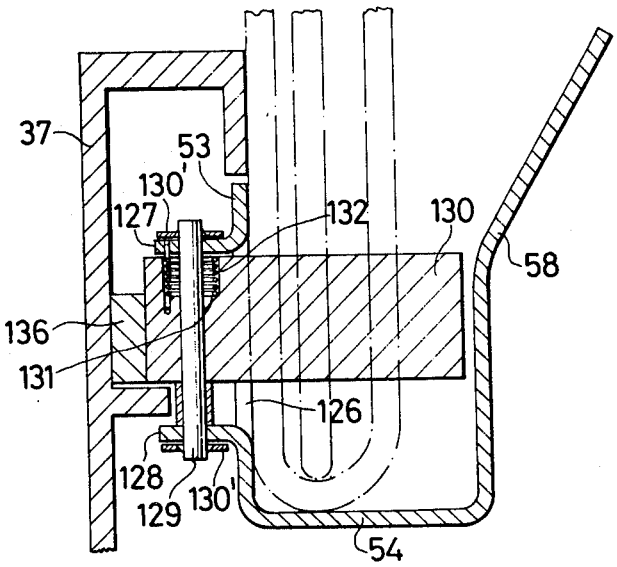
FIG. 10 is a sectional view taken along the line 10—10 of FIG. 9.

This opening 126 will be particularly well recognized from the showing of FIGS. 7 to 10. A pin 129 is fixedly clamped by means of lock washers or spring rings 130' or the like between two flaps or tabs 127, 128 flexed away from the leg 53 through the opening 126 and also extending away from the sheet metal guide member 58. Pivotably mounted upon this pin 129 is a stop finger 130 of approximately wedge-shaped configuration in plan view. A spiral spring 132 is arranged in a countersunk portion 131 formed in the stop finger 130 and disposed coaxially with respect to the pin 129. One end of this spiral spring 132 is inserted into the tab or flap portion 127 and its other end in the floor of the countersunk portion 131, as shown in FIG. 10. The arrangement is such that the spring 132 strives to hold the stop finger 130 in the position illustrated in FIG. 8. From this position the stop finger 130 can be rocked against the action of the spring 132 in both rotational or pivotal directions. Both of its sides or faces designated by reference characters 133 and 134 and the intermediately situated rounded corner 135 cooperate with a control cam track or bracket 136 secured at the inside of the axially non-displaceable C-shaped profile rail 37. The contact surface or cam surface 137 of the track or bracket 136 is shaped in such a manner that the stop finger 130, during the course of the return stroke (arrow R in FIGS. 7 to 9) of the parts or components displaceable in the compartments or cells 35, and to which parts there also belong the leg 53, is rocked from a position where it has been pivoted out of the compartment 35 (FIG. 7) into a position engaging into the compartment or cell (FIGS. 9 and 10). In this position the side or face 138 of the stop finger 130 pushes back printed products which have possibly been pushed too far towards the front until they, for instance, snugly bear at the sheet metal guide member 122 at the region of the infeed location Z. It should be apparent that for each compartment there is present a set of such stop or impact fingers 130 and the stop fingers are arranged axially in spaced relationship from one another by an amount exactly corresponding to the stroke *h*. Since with the illustrated apparatus 11 there are provided three gripper sets, hence as best seen by referring to FIG. 2, for each compartment or cell there are likewise provided three stop or impact fingers 130. During the work stroke these stop fingers 130 of course are again rocked back until they assume the position shown in FIG. 7.

From the showing of FIG. 2 it will be apparent that in each instance only the stop finger 130 of each of the compartments appearing at the left side thereof is capable of coacting with the sheet metal guide member 122. The other stop fingers 130 cooperate with stops which can be traveled over and which will be described more fully in conjunction with FIGS. 5 and 6.

Figure 5:
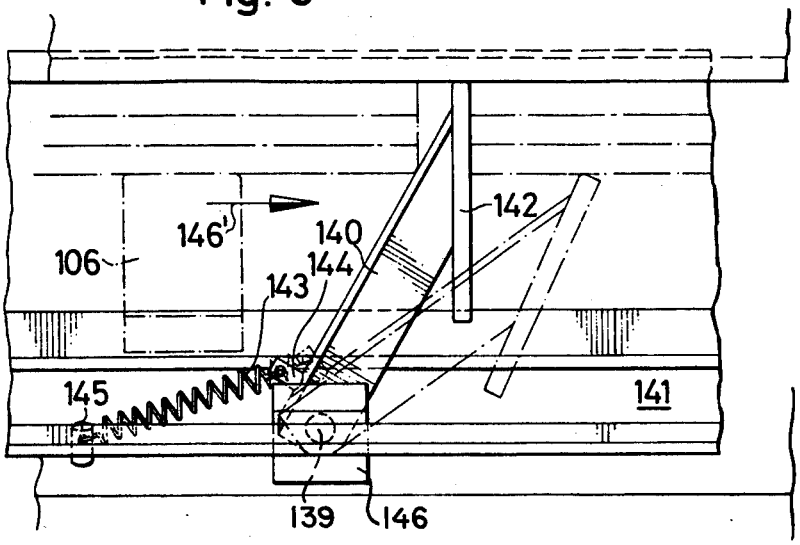
FIG. 5 is a detail showing, transverse to the axis of the cell wheel, of a stop which can be ridden- or traveled-over and which prevents the return of the printed products moved in axial direction upon the return of the entrainment member.
Figure 6:
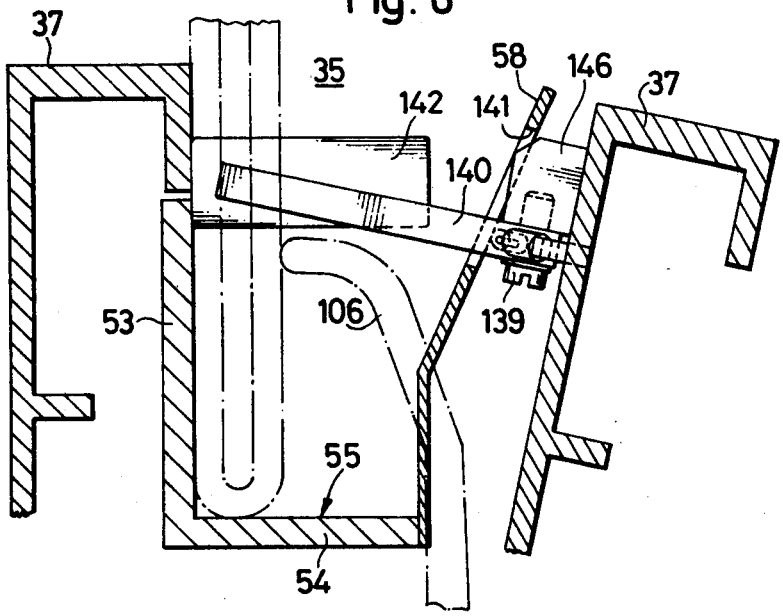
FIG. 6 is a view in axial direction of the detail showing of FIG. 5.
Figure 7:
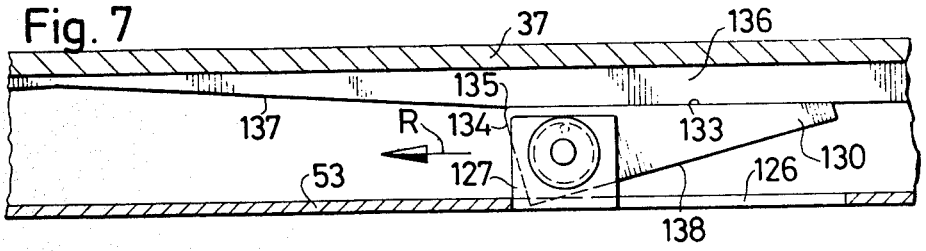
FIG. 7 to 9 are plan views transverse to the cell wheel axis illustrating different operational positions of a cam trackcontrolled stop moved to-and-fro with the entrainment members, this stop, during the course of the return stroke of the entrainment member, pushing back onto the ride-over stop of FIGS. 5 and 6 the printed products which may have been possibly pushed forward too far during the work stroke.
Figure 8:
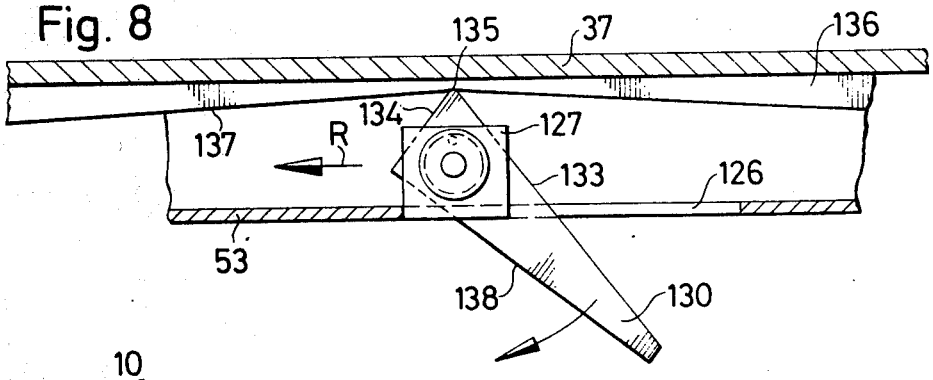

There will be seen in FIG. 6, in section, parts of two neighboring profile rails 37, the intermediate located profile element 55 with its two legs 53 and 54 and the sheet metal guide member 58 secured thereat. At a block 146 attached to the rear face of the profile rail 37 there is pivotably mounted an arm or cantilever 140 by means of a threaded pin 139. The arm 140 engages through a slot 141 formed in the sheet metal guide 58 and carries at its free end a stop vane or plate 142. A tension spring 143 is hooked at one end in an eyelet 144 of the arm 140 and at the other end at a pin 145 attached to the rear face of the profile rail 37. The tension spring 143 has the tendency of retaining the arm 140 and thus the stop vane or plate 142 in its extended position i.e. the position blocking the compartment 35. The arrangement is effectuated in a manner that the spacing of the stop vane or plate 142 from the sheet metal guide 122 at the start of the relevant compartment or cell corresponds to the stroke $h_2$ or an integral multiple thereof. Due to its construction the stop formed by the arm 140 and the stop vane 142 is however capable of being traveled over, so that the printed products which have been advanced during the work stroke (arrow 146' of FIG. 5) are capable of rocking the arm or cantilever 140 against the action of the tension spring 143 and thus providing a free throughpassage through the compartment or cell. This is illustrated in FIG. 5 in phantom lines. However, as soon as the printed products have moved past the arm 140 and the stop vane 142, this stop rocks back into the compartment. During the course of the return stroke it is then the stop fingers 130 which push back the printed products against the stop surface of the stop vane or plate 140. From the showing of FIG. 6 it will be apparent that the arm 140 together with the stop vane or plate 142 are arranged at such an elevation that the gripper jaws 106 can move without being hindered below the stop vane or plate 142.

In this way there are provided all of the measures needed to insure that each printed product 34, during its passage through the apparatus 11, is fixedly positioned at any point in time with regard to its location in the relevant compartment or cell 35. Such constitutes the prerequisites for exact processing of the products. The devices required for this purpose are arranged to be axially non-displaceable for instance at the partition walls 36. Thus, each of the compartments or cells 35 can be considered to a certain extent as constituting a processing line in which the printed products are forwardly advanced or shifted in a stepwise manner and at the end of each step experience a processing operation. Since the described apparatus 11 is provided for the most different processing operations it is not felt necessary to further describe in detail the processing devices, particularly since basically the heretofore known processing devices which are employed in linear processing lines are also suitable for use with the apparatus 11 of this development.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An apparatus for processing products, especially printed products comprising:

a. a revolving cell wheel having an axis of rotation and means providing compartments for the cell wheel;

b. means mounting said cell wheel for rotation about said axis of rotation;

c. means for rotating said cell wheel about said axis of rotation;

d. means defining an infeed location for the delivery of products into the compartments of said cell wheel where the products are processed while residing in said compartments;

e. means defining an outfeed location for the removal of the products from said compartments of said cell wheel;

f. said infeed location and said outfeed location being arranged in offset relationship in the direction of the axis of rotation of said cell wheel;

g. a plurality of product entrainment means arranged in each compartment for axial movement through a work stroke and a return stroke, the axial length of said work stroke being only a fraction of the axial length of said cell wheel;

h. means individual to each compartment for operatively coupling the plurality of entrainment means of the respective compartment with one another; and i. drive means for driving said entrainment means, said drive means comprising a common stationary guide track describing a closed curve and follower elements coacting with said stationary guide and rotating with said cell wheel to cause said axial movement of said plurality of entrainment means of said respective compartment.

2. The apparatus as defined in claim 1, wherein said drive means include means providing a substantially cylindrical surface arranged substantially coaxially with respect to the axis of rotation of the cell wheel, said guide track being arranged at said cylindrical surface.

3. The apparatus as defined in claim 2, wherein the compartments have floors, said means providing the cylindrical surface including an outer jacket surface of a drum having a diameter smaller than the diameter of the rotational path of travel of the floors of the compartments of the revolving cell.

4. The apparatus as defined in claim 2, wherein the guide track wraps once about said cylindrical surface.

5. The apparatus as defined in claim 4, wherein the guide track defines a stroke amounting to $1/n$ of the axial spacing of the infeed location from the outfeed location, wherein $n$ is an integer.

6. The apparatus as defined in claim 3, wherein the cell wheel has opposed ends, said drum is arranged at the region of the one end of the cell wheel.

7. The apparatus as defined in claim 6, further including a cantilever carried by each compartment, each said cantilever having a free end carrying one said follower element cooperating with the guide track.

8. The apparatus as defined in claim 3, wherein said mounting means includes a stationary support shaft upon which there is secured said drum, bearing means for rotatably mounting the cell wheel upon said stationary shaft, said drum and cell wheel being coaxially arranged with respect to one another.

9. The apparatus as defined in claim 8, further including means for adjusting the position of said drum and for fixing the adjusted position of said drum.

10. The apparatus as defined in claim 3, further including a stationary track, said means individual to each compartment comprising a gripper shaft, said entrainment means including grippers mounted on the gripper shaft for gripping the printed products, drive means for rotating the gripper shaft in at least one rotational sense, the drive means including a follower element cooperating with said track, said track being mounted at the jacket surface of the drum.

11. The apparatus as defined in claim 10, said drum being arranged at the region of an end face of said cell wheel.

12. The apparatus as defined in claim 1, wherein one said follower element is provided for each compartment of the cell wheel and said plurality of entrainment means arranged in each such compartment, said follower element engaging with the guide track in each rotational position of the cell wheel with respect to the guide track.

13. The apparatus as defined in claim 1, wherein the entrainment means comprise a plurality of grippers which can be opened and closed, and means for closing the grippers prior to the start of a work stroke and for opening the grippers prior to the start of a return stroke.

14. The apparatus as defined in claim 13, further including stop means arranged in the compartments in the direction of the work stroke for preventing a return movement of the products in the compartment during the return stroke.

15. The apparatus as defined in claim 13, wherein each gripper possesses a stationary gripper jaw and a movable gripper jaw which can move towards the stationary gripper jaw.

16. The apparatus as defined in claim 15, wherein all of the grippers of a compartment possess a common stationary jaw means defining said stationary gripper jaw for each gripper.

17. The apparatus as defined in claim 15, wherein said means individual to each compartment comprises a gripper shaft extending parallel to the lengthwise direction of its associated compartment, all movable gripper jaws of such associated compartment being connected to said gripper shaft.

18. The apparatus as defined in claim 17, wherein the movable gripper jaws are pivotably mounted upon the gripper shaft, stop means secured rigidly for rotation at the gripper shaft, spring means for biasing the movable gripper jaws in the closing direction thereof at the stop means.

19. The apparatus as defined in claim 18, including articulated drive means for rotating the gripper shaft at least in one rotational sense.

20. The apparatus as defined in claim 19, further including a stationary track means, said articulated drive means including a follower member cooperating with said stationary track means.

21. The apparatus as defined in claim 17, further including a return spring, one direction of rotation of the gripper shaft corresponding to the closing direction of the gripper jaws, and the gripper shaft is rotatable in this direction against the action of the return spring.

22. The apparatus as defined in claim 19, further including a return spring, one direction of rotation of the gripper shaft corresponding to the closing direction of the gripper jaws, the gripper shaft is rotatable in this direction against the action of the return spring, and the return spring engages at the articulated drive means.

23. The apparatus as defined in claim 1, wherein the axis of rotation of said cell wheel is substantially horizontal, said cell wheel having a jacket surface, pairs of rotatably mounted rollers engaging along circles of the jacket surface of the cell wheel for supporting the latter.

24. The apparatus as defined in claim 23, wherein said cell wheel comprises essentially similar structural components, means for coaxially securing said structural components to one another.

25. The apparatus as defined in claim 24, wherein said structural components are secured to one another by means of screw collar rings defining said securing means.

26. The apparatus as defined in claim 25, wherein the rollers are provided with rims, the cell wheel being supported via the screw collar rings at said rollers.

27. The apparatus as defined in claim 23, wherein said drive means for the cell wheel occurs via at least one of the rollers.

28. An apparatus for processing products, comprising:

a. a revolving cell wheel having an axis of rotation and means providing compartments for the cell wheel;

b. means mounting said cell wheel for rotation about said axis of rotation;

c. means for rotating said cell wheel about said axis of rotation:

d. means defining an infeed location for delivery of products into the compartments of said cell wheel where the products are processed while residing in said compartments;

e. means defining an outfeed location for the removal of the products from said compartments of said cell wheel;

f. said infeed location and said outfeed location being arranged in spaced relationship in the direction of the axis of rotation of said cell wheel;

g. a plurality of product entrainment means arranged in each compartment for axial movement therein through a product engaging work stroke and a product disengaging return stroke, the axial length of said work stroke being only a fraction of the axial length of cell wheel;

h. means individual to each compartment operatively coupling the plurality of entrainmant means of the respective compartment with one another for simultaneous actuation of said plurality of entrainment means of said respective compartment; and i. drive means for driving said entrainment means such that the products in each compartment are passed lengthwise of such compartment progressively to each of the plurality of entrainment means of such compartment.

29. An apparatus for processing products, comprising:

a. a revolving cell wheel having opposed ends and rotatable about a predetermined axis of rotation;

b. means providing compartments for the cell wheel extending intermediate the opposed ends of said cell wheel;

c. said compartment providing means including movable means for each compartment for shifting at least part of each compartment in the lengthwise direction thereof;

d. means for rotating said cell wheel about said axis of rotation;

e. means defining an infeed location for the supply of products into the compartments of said cell wheel;

f. means defining an outfeed location for the removal of the products from said compartments of said cell wheel;

g. said infeed location and said outfeed location being arranged in spaced relationship in the direction of the axis of rotation of said cell wheel;

h. means for selectively axially moving the movable part of each compartment only through a distance which is less than the axial length of such compartment; and i. means for preventing return movement of products which have advanced from said infeed location toward said outfeed location.

30. An apparatus for processing products, especially printed products comprising:

a. a revolving cell wheel having an axis of rotation and means providing compartments for the cell wheel;

b. means mounting said cell wheel for rotation about said axis of rotation;

c. means for rotating said cell wheel about said axis of rotation;

d. means defining an infeed location for the delivery of products into the compartments of said cell wheel where the products are processed while residing in said compartments;

e. means defining an outfeed location for the removal of the products from said compartments of said cell wheel;

f. said infeed location and said outfeed location being arranged in offset relationship in the direction of the axis of rotation of said cell wheel;

g. a plurality of product entrainment means arranged in each compartment for movement through a work stroke and a return stroke, the length of said work stroke being only a fraction of the axial length of said cell wheel, said entrainment means comprising a plurality of grippers, means for closing the grippers prior to initiation of said work stroke and for opening the grippers prior to initiation of said return stroke, all of the grippers of a compartment having a common stationary gripper jaw, a movable gripper jaw movable toward said stationary gripper jaw, said common stationary gripper jaw comprising a leg of a substantially U-shaped channel further defining floor means of the compartment associated therewith, said channel comprising part of said means providing said compartments;

h. means individual to each compartment for operatively coupling the plurality of entrainment means of the respective compartment with one another; and i. drive means for driving said entrainment means, said drive means comprising a common stationary guide track describing a closed curve and follower elements rotating with said cell wheel.

31. The apparatus as defined in claim 30, further including rotatable rollers secured in spaced relationship from one another along said channel at an outer surface thereof, a guide rail extending essentially parallel to the axis of rotation of the cell wall, said rollers engaging with said guide rail.

32. The apparatus as defined in claim 30, wherein said substantially U-shaped channel has an open side and a side facing away from said open side, said means individual to each compartment comprises a gripper shaft rotatably mounted at said side facing away from the open side, said gripper shaft being axially movable along with the channel, a plurality of the movable gripper jaws being coupled with said gripper shaft, said channel having a further leg provided with an opening through which engage each of the movable gripper jaws during the course of their closing movement.

33. The apparatus as defined in claim 32, including means for rotatably mounting the movable gripper jaws upon the gripper shaft, stop means secured rigidly for rotation upon the gripper shaft, and spring means for pre-biasing the movable gripper jaws in the direction of the closing movement thereof at the stop means.

34. The apparatus as defined in claim 32, wherein the gripper shaft is subdivided into individual coaxial sections, and means for coupling the individual sections rigidly for rotation with one another.

35. The apparatus as defined in claim 30, including a cantilever secured to the U-shaped channel, said cantilever having a free end carrying the follower element cooperating with the guide track.

36. An apparatus for processing products, especially printed products comprising:

a. a revolving cell wheel having an axis of rotation ans means providing compartments for the cell wheel;
b. means mounting said cell wheel for rotation about said axis of rotation;
c. means for rotating said cell wheel about said axis of rotation;
d. means defining an infeed location for the delivery of products into the compartments of said cell wheel where the products are processed while residing in said compartments;
e. means defining an outfeed location for the removal of the products from said compartments of said cell wheel;
f. said infeed location and said outfeed location being arranged in offset relationship in the direction of the axis of rotation of said cell wheel;
g. a plurality of product entrainment means arranged in each compartment for movement through a work stroke and a return stroke, the length of said work stroke being only a fraction of the axial length of said cell wheel, said entrainment means comprising a plurality of grippers, means for closing the grippers prior to initiation of said work stroke and for opening the grippers prior to initiation of said return stroke, each gripper having a stationary gripper jaw and a movable gripper jaw movable toward the stationary gripper jaw;
h. means individual to each compartment for operatively coupling the plurality of entrainment means of the respective compartment with one another, said means individual to each compartment comprising a gripper shaft extending parallel to the lengthwise direction of its associated compartment, all of said movable gripper jaws of said associated compartment being pivotally connected to said gripper shaft, stop means secured rigidly for rotation at the gripper shaft, spring means for biasing the movable gripper jaws in the closing direction thereof at the stop means, articulated drive means for rotating the gripper shaft at least in one rotational direction, a releasable free-wheeling device having a locking position and coupling said articulated drive means with the gripper shaft, said free-wheeling device in said locking position securing the gripper shaft against rotation opposite the closing direction of the movable gripper jaws; and
i. drive means for driving said entrainment means, said drive means comprising a common stationary guide track describing a closed curve and follower elements rotating with said cell wheel.

37. An apparatus for processing products, especially printed products comprising:

a. a revolving cell wheel having an axis of rotation and means providing compartments for the cell wheel;
b. means mounting said cell wheel for rotation about said axis of rotation;
c. means for rotating said cell wheel about said axis of rotation;
d. means defining an infeed location for the delivery of products into the compartments of said cell wheel where the products are processed while residing in said compartments;
e. means defining an outfeed location for the removal of the products from said compartments of said cell wheel;
f. said infeed location and said outfeed location being arranged in offset relationship in the direction of the axis of rotation of said cell wheel;
g. a plurality of product entrainment means arranged in each compartment for movement through a work stroke and a return stroke, the length of said work stroke being only a fraction of the axial length of said cell wheel, said entrainment means comprising a plurality of grippers, means for closing the grippers prior to initiation of said work stroke and for opening the grippers prior to initiation of said return stroke, each gripper having a stationary gripper jaw and a movable gripper jaw movable toward the stationary gripper jaw;
h. means individual to each compartment for operatively coupling the plurality of entrainment means of the respective compartment with one another, said means individual to each compartment comprising a gripper shaft extending parallel to the lengthwise direction of its associated compartment, all of said movable gripper jaws of said associated compartment being pivotally connected to said gripper shaft, stop means secured rigidly for rotation at the gripper shaft, spring means for biasing the movable gripper jaws in the closing direction thereof at the stop means, articulated drive means for rotating the gripper shaft at least in one rotational direction, a return spring engaging at said articulated drive means, one direction of rotation of the gripper shaft corresponding to the closing direction of the movable gripper jaws, said gripper shaft being rotatable in said one direction of rotation against the action of said return spring, a releasable free-wheeling device having a locking position and coupling said articulated drive means with the gripper shaft, said free-wheeling device in said locking position securing the gripper shaft against rotation opposite the closing direction of the movable gripper jaws, cam means associated with said releasable free-wheeling device, a release lever means provided for said releasable free-wheeling device and coacting with said cam means for releasing said device once during the course of one revolution of the cell wheel; and
i. drive means for driving said entrainment means, said drive means comprising a common stationary guide track describing a closed curve and follower elements rotating with said cell wheel.

38. The apparatus as defined in claim 37, wherein the cam means is secured to said drum.

* * * * *